US006095442A

United States Patent [19]

Doelle

[11] Patent Number: 6,095,442

[45] Date of Patent: Aug. 1, 2000

[54] PERFORATED DRUM IN A STOCK PREPARATION SYSTEM FOR SCREENING FOREIGN MATTER FROM RECYCLED PAPER

[75] Inventor: Klaus Doelle, Appleton, Wis.

[73] Assignee: Voith Sulzer Paper Technology North America, Inc., Appleton, Wis.

[21] Appl. No.: 09/216,570

[22] Filed: Dec. 18, 1998

[51] Int. Cl.[7] ..... B02C 23/10

[52] U.S. Cl. ..... 241/74; 241/79.3; 209/3; 209/298

[58] Field of Search ..... 209/3, 279, 288, 209/296, 297, 298; 241/79, 74, 79.3, DIG. 38

[56] References Cited

U.S. PATENT DOCUMENTS 1,897,156 2/1933 Wells ..... 209/279
2,983,378 5/1961 Hilkemeier ..... 209/279
4,538,767 9/1985 Pimley ..... 241/79.3
5,593,096 1/1997 Harker et al. ..... 241/79

*Primary Examiner*—Mark Rosenbaum
*Attorney, Agent, or Firm*—Taylor & Aust, P.C.

[57] ABSTRACT

An apparatus for screening foreign matter from dry recycled paper includes a feed device with an outlet for discharging the recycled paper. A frustroconical shaped drum has an open wide end positioned adjacent to the discharge outlet for receiving the recycled paper and an open narrow end for discharging the recycled paper. The drum is rotatable during use about an axis of rotation and has a shell with a plurality of foils attached to an inside surface thereof for moving the recycled paper through the drum from the wide end to the narrow end. The shell has a plurality of holes therein which are sized to allow the foreign matter to fall therethrough via gravitational force and to prevent substantially all of the recycled paper from falling therethrough.

14 Claims, 2 Drawing Sheets

PERFORATED DRUM IN A STOCK PREPARATION SYSTEM FOR SCREENING FOREIGN MATTER FROM RECYCLED PAPER

BACKGROUND OF THE INVENTION

1. Field of the Invention

The present invention relates to a fiber stock preparation system used for preparing a fiber stock for use in a paper-making machine, and, more particularly, to an apparatus for screening foreign matter from dry recycled paper in such a fiber stock preparation system.

2. Description of the Related Art

A fiber stock preparation system is used to prepare a fiber stock or fiber suspension for use in a paper-making machine. The fiber stock preparation system utilizes a source of fiber which is mechanically and chemically prepared for use in the paper-making machine. Sources of such fiber include trees and recycled paper.

It will be appreciated that foreign matter such as metal, plastic, sand and other contaminants must be removed from the source of fiber for the fiber to be used in the paper-making process. Sand, other types of soil, and other small particulate foreign matter adversely affect the quality of the fiber web which is produced in the paper-making machine if not removed during the fiber stock preparation process.

What is needed in the art is an apparatus which allows easy separation of small, particulate foreign matter from a source of fiber such as recycled paper in bale or loose form.

SUMMARY OF THE INVENTION

The present invention provides a frustroconical shaped drum which receives dry recycled paper and which includes a shell having a plurality of holes which allow foreign matter such as sand to fall therethrough to separate the foreign matter from the recycled paper.

The invention comprises, in one form thereof, an apparatus for screening foreign matter from dry recycled paper. A feed device has an outlet for discharging the dry recycled paper. A frustroconical shaped drum has an open wide end positioned adjacent to the discharge outlet for receiving the recycled paper and an open narrow end for discharging the recycled paper. The drum is rotatable during use about an axis of rotation and has a shell with a plurality of foils attached to an inside surface thereof for moving the recycled paper through the drum from the wide end to the narrow end. The shell has a plurality of holes therein which are sized to allow the foreign matter to fall therethrough via gravitational force and to prevent substantially all of the recycled paper from falling therethrough.

An advantage of the present invention is that foreign matter such as sand is easily and quickly separated from the recycled paper.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
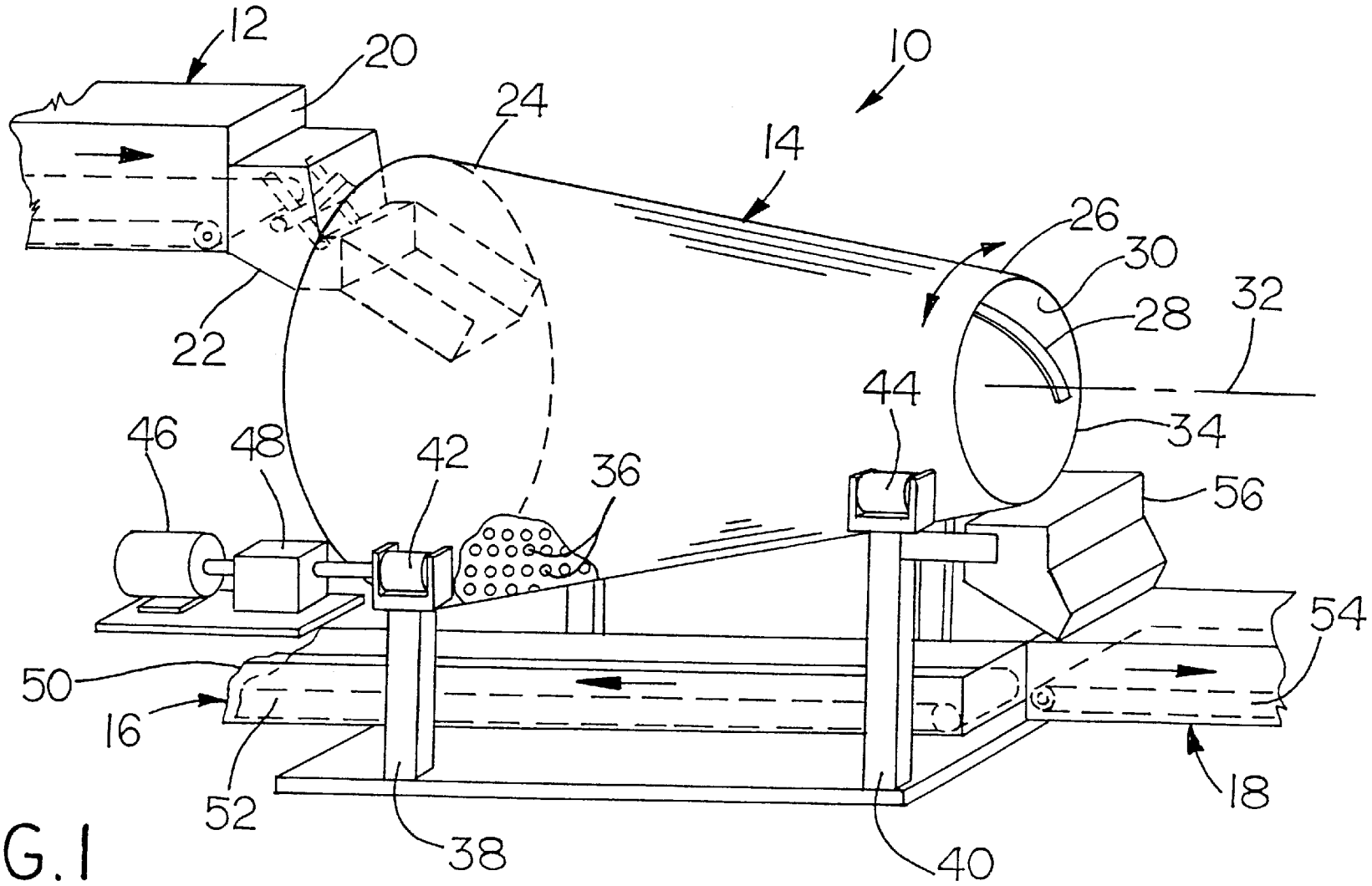
FIG. 1 is a perspective view of an embodiment of an apparatus for screening small particulate foreign matter from recycled paper in a fiber stock preparation system.
Figure 2:
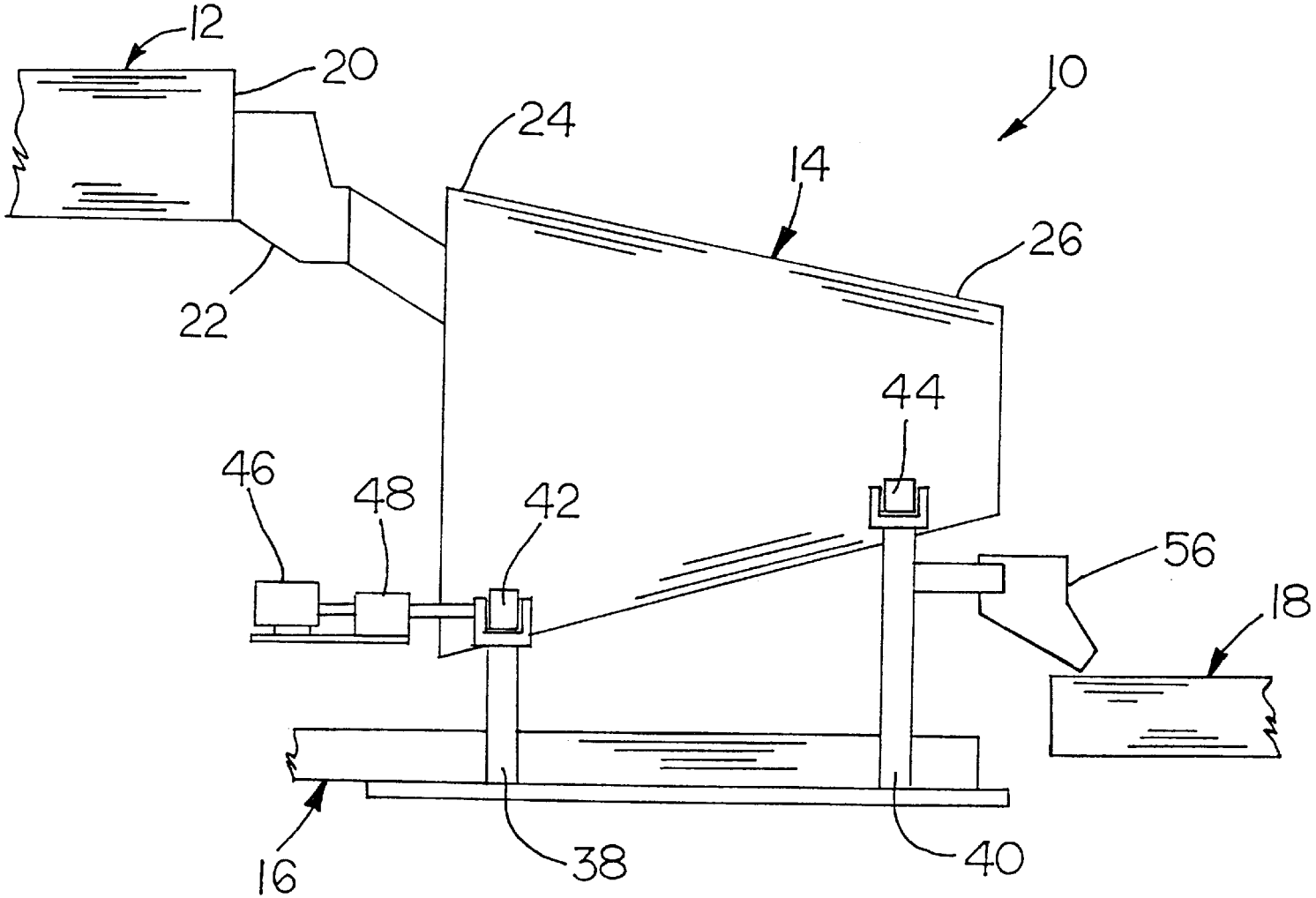
FIG. 2 is side view of the apparatus of FIG. 1.

Referring now to the drawings, there is shown an embodiment of an apparatus 10 for screening foreign matter from recycled paper. Apparatus 10 generally includes a feed device 12, drum 14, belt conveyor assembly 16 and transfer conveyor assembly 18.

Feed device 12 is used to transfer recycled paper in bale or loose form to drum 14. Feed device 12 is in the form of a conveyor in the embodiment shown and includes an outlet 20 for discharging the recycled paper.

A shredder 22 is optionally attached to outlet 20 of feed device 12. Shredder 22 shreds the recycled paper into smaller pieces which are fed into drum 14.

Drum 14 is frustroconical shaped and has an open wide end 24 positioned relative to outlet 20 to receive the recycled paper which is transported through feed device 12 and shredded by shredder 22. Drum 14 also includes an open narrow end 26 for discharging the recycled paper. A cork screw shaped foil 28 is attached to an inside surface 30 of drum 14 and moves the recycled paper from wide end 24 to narrow discharge end 26. Foil 28 is a continuous foil in the embodiment shown, but may also consist of a plurality of foil segments which conjunctively move the recycled paper from wide end 24 to narrow end 26.

Drum 14 is rotatable during use about an axis of rotation 32, as will be described in more detail hereinafter. Drum 14 includes a shell 34 which is substantially entirely formed with a plurality of holes 36. Holes 36 are sized to allow small particulate foreign matter such as sand to fall therethrough via gravitational force and to prevent substantially all of the recycled paper from falling therethrough. Holes 36, in the embodiment shown, are in the form of circular shaped holes with a diameter of between approximately 0.5 and 1.0 inch, preferably between approximately 0.7 and 0.9 inch, and more preferably have a diameter of approximately 0.8 inch. Circular shaped holes with a diameter of approximately 0.8 inch are sufficient to allow the small particulate foreign matter to fall therethrough via gravitational force, while at the same time maintaining the recycled paper within drum 14. Of course, it will be appreciated that the size of holes 36 may vary depending upon the extent to which the recycled paper is shredded before entering drum 14.

Holes 36 may also be formed with other shapes which allow the small particulate foreign matter to fall therethrough while maintaining the recycled paper within drum 14. For example, holes 36 may be formed with a slot shape or other shape which allows the small particulate foreign matter to fall therethrough while maintaining the recycled paper within drum 14. The size and shape of holes 36 may be relatively easily empirically determined, dependent upon the size and condition of the recycled paper which is fed into drum 14.

Drum 14 is supported at each end thereof by a pair of frames 38 and 40. Each frame 38 and 40 includes a plurality of rolls 42 and 44 which in turn rotatably support and carry drum 14. A roll 42 carried by frame 38 is rotatably driven by a rotatable drive 46 in the form of an electric motor. A gear box 48 coupled with an output shaft from motor 46 is used to adjust the rotational speed of motor 46 to a desired rotational speed of drum 14. In the embodiment shown, drum 14 is driven by electric motor 46 with a rotational speed of between approximately 3 and 30 RPM, depending upon the specific application.

Frames 38 and 40 are configured to carry drum 14 at the desired height and angular orientation. In the embodiment shown, frames 38 and 40 position drum 14 above collector chute 50, and orient drum 14 such that axis of rotation 32 is substantially horizontal. Of course, it will be appreciated that drum 14 may be oriented such that the axis of rotation 32 is other than horizontal, depending upon the specific application.

Belt conveyor assembly 16 is disposed below drum 14 and includes a collector chute 50 which receives the small particulate foreign matter which passes through the plurality of holes 36 in shell 34. A belt conveyor 52 is disposed in the bottom of collector chute 50 for transporting the foreign matter away from collector chute 50.

A transfer conveyor 54 with an associated input hopper 56 is positioned adjacent to narrow end 26 of drum 14 and receives the screened recycled paper from drum 14. Transfer conveyor 54 transports the screened recycled paper to another apparatus in a fiber stock preparation system, such as a pulper.

During use, recycled paper is fed through conveyor 12 and discharged into shredder 14. Shredder 14 shreds the recycled paper to a smaller size and in turn discharges the recycled paper into wide end 24 of drum 14. Drum 14 is rotatably driven using electric motor 46. Foil 28 within drum 14 moves the recycled paper from wide end 24 to narrow discharge end 26. As the recycled paper travels through drum 14, small particulate foreign matter such as sand within the recycled paper falls through holes 36 in shell 34. The foreign matter falls into collector chute 50 and is transported away for disposal using belt conveyor 52. The screened recycled paper is discharged from narrow end 26 into hopper 56. The screened recycled paper then falls into transfer conveyor 54 and is transported to a pulper to be broken down into a fiber pulp.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for screening foreign matter from dry recycled paper, comprising:

a feed device having an outlet configured for discharging the dry recycled paper;

a frustroconical shaped drum having an open wide end positioned relative to said discharge outlet configured for receiving the dry recycled paper and an open narrow end configured for discharging the recycled paper, said drum being rotatable during use about an axis of rotation and having a shell with a plurality of foils attached to an inside surface thereof for moving the recycled paper through said drum from said wide end to said narrow end, said shell having a plurality of holes therein, said holes sized to allow the foreign matter to fall therethrough via gravitational force and to prevent substantially all of the recycled paper from falling therethrough; and a transfer conveyor positioned adjacent to said narrow end of said drum configured for receiving the screened recycled paper from said drum, said transfer conveyor being further configured to transport the screened recycled paper to a pulper.

2. The apparatus of claim 1, further comprising a shredder attached to said outlet of said feed device for shredding the recycled paper.

3. The apparatus of claim 1, further comprising a collector chute disposed below said drum for receiving the foreign matter which passes through said plurality of holes.

4. The apparatus of claim 3, further comprising a belt conveyor disposed in a bottom of said collector chute for transporting the foreign matter away from said collector chute.

5. The apparatus of claim 1, wherein said plurality of holes are one of circular shaped and slot shaped.

6. The apparatus of claim 1, wherein said plurality of holes each are circular shaped with a diameter of between approximately 0.5 and 1.0 inch.

7. The apparatus of claim 6, wherein said holes each have a diameter of between approximately 0.7 and 0.9 inch.

8. The apparatus of claim 7, wherein said holes each have a diameter of approximately 0.8 inch.

9. The apparatus of claim 1, wherein said feed device comprises a conveyor.

10. The apparatus of claim 1, further comprising a pair of frames respectively positioned at each end of said drum, each said frame carrying a plurality of rollers which in turn rotatably support and carry said drum.

11. The apparatus of claim 10, further comprising a rotatable drive connected with and rotatably driving at least one of said rollers associated with one of said frames.

12. The apparatus of claim 1, wherein said axis of rotation of said drum is positioned substantially horizontally.

13. The apparatus of claim 1, wherein said feed device is configured to transfer the dry recycled paper in the form of at least one of baled paper and loose paper.

14. The apparatus of claim 1, wherein said holes are sized to allow sand to fall therethrough.

* * * * *